US007374268B2

(12) United States Patent
Tajika et al.

(10) Patent No.: US 7,374,268 B2
(45) Date of Patent: May 20, 2008

(54) INK JET RECORDING APPARATUS AND INK JET RECORDING METHOD

(75) Inventors: Hiroshi Tajika, Tokyo (JP); Yuji Konno, Tokyo (JP); Norihiro Kawatoko, Tokyo (JP); Takayuki Ogasahara, Tokyo (JP); Tetsuya Edamura, Tokyo (JP); Atsuhiko Masuyama, Tokyo (JP); Akiko Maru, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 11/420,644

(22) Filed: May 26, 2006

(65) Prior Publication Data

US 2006/0214972 A1 Sep. 28, 2006

Related U.S. Application Data

(63) Continuation of application No. 10/835,304, filed on Apr. 28, 2004, now Pat. No. 7,083,248.

(30) Foreign Application Priority Data

May 1, 2003 (JP) ..... 2003-126700

(51) Int. Cl.
*B41J 2/205* (2006.01)
*B41J 29/38* (2006.01)

(52) U.S. Cl. ..... 347/15; 347/14; 347/16

(58) Field of Classification Search ..... 347/15, 347/95, 101; 358/3.08; 399/364, 374
See application file for complete search history.

(56) References Cited

U.S. PATENT DOCUMENTS

| | | | | |
|---|---|---|---|---|
| 4,785,313 | A | 11/1988 | Higuma | |
| 5,508,811 | A | 4/1996 | Abe et al. | |
| 6,336,705 | B1 * | 1/2002 | Torigoe | 347/43 |
| 6,390,617 | B1 | 5/2002 | Iwao | |
| 6,467,896 | B2 | 10/2002 | Meyer et al. | |

FOREIGN PATENT DOCUMENTS

| | | |
|---|---|---|
| JP | 62-140878 | 6/1987 |
| JP | 5261911 | 10/1993 |
| JP | 7-276716 | 10/1995 |
| JP | 10-324038 | 12/1998 |
| JP | 2000-103052 | 4/2000 |

* cited by examiner

*Primary Examiner*—Matthew Luu
*Assistant Examiner*—Lisa M Solomon

(57) ABSTRACT

An ink jet recording method and apparatus for recording pictures, characters, etc. on both sides of a recording medium by ejecting a first ink and a second ink on the same side of the medium, wherein the first ink is ejected based on mirror data corresponding to a mirror image of the image to be recorded and the second ink is ejected based on data corresponding to the image to be recorded.

4 Claims, 10 Drawing Sheets

INK JET RECORDING APPARATUS AND INK JET RECORDING METHOD

CROSS-REFERENCE TO RELATED APPLICATIONS

This application is a continuation of application Ser. No. 10/835,304, filed Apr. 28, 2004, the contents of which are hereby incorporated by reference.

BACKGROUND OF THE INVENTION

1. Field of the Invention

The present invention relates to ink jet recording apparatuses and ink jet recording methods in which picture and character information is printed on recording media. More particularly, the invention relates to ink jet recording apparatuses and ink jet recording methods for recording pictures, characters, etc. on both sides of recording media.

2. Description of the Related Art

When recording is performed on both sides of a recording sheet using a common recording apparatus, such as an ink jet printer, usually, after recording is performed on one side of the sheet, the sheet is turned over and set into a feeder by the user, and recording is performed again on the other side.

Many techniques are also known in which the reversal of a recording medium, such as a sheet of paper, is automatically performed and double-side recording is enabled without bothering the user. For example, Japanese Patent Laid-Open No. 10-324038 (Applicant: Fuji Xerox Co., Ltd.) discloses a structure which prevents an increase in recording time when double-side recording is performed, and moreover, which reduces degradation in image quality due to smears during back-side recording and stains on the recording sides during the reversal of the recording medium.

In ink jet recording, the size of the recording apparatus can be easily reduced. Therefore, methods have been proposed in which both sides of a recording medium are simultaneously recorded by a plurality of recording units provided on both sides to perform double-side recording. For example, Japanese Patent Laid-Open No. 07-276716 (Applicant: NEC Corp.) discloses such an apparatus. Japanese Patent Laid-Open Nos. 2000-103052 (Applicant: Brother Industries, Ltd.) and 05-261911 (Applicant: Seiko Epson Corp.) also disclose double-side recording using intermediate transfer media.

However, in the conventional structure in which the recording medium is automatically reversed to perform double-side recording, the mechanism for reversal and transport causes an increase in the apparatus cost. Curling of the recording medium due to the reversal and transport is also a substantial problem. Because of the reversal, since the transport distance for the recording medium is also increased compared with single-side printing, there is an increased possibility of smears and stains on the recording sides. Furthermore, in the structure which includes the apparatus provided with the reversal mechanism and in which inks are ejected on both sides to perform double-side recording, since inks are ejected on both sides, the amounts of inks absorbed by the recording medium are relatively increased, resulting in cockling, setoff, and unsatisfactory fixing properties.

A recording medium referred to as a back print film is known in which the recording side is different from the viewing side. Such a recording medium is disclosed, for example, in Japanese Patent Laid-Open No. 62-140878.

This recording medium includes a transparent base; a non-porous layer disposed on the base, the non-porous layer being capable of holding a coloring material (dye) of ink; and a porous layer disposed on the non-porous layer, the porous layer being capable of passing the coloring material. In the recording medium, recording is performed by ejecting dye ink on the porous layer at the front side, and an image formed by the coloring material permeated through the porous layer and held by the non-porous layer is viewed from the back side, i.e., the transparent base side. In the recording method using such a recording medium, the image formed with ink is protected by the base, and it is possible to reduce the influence of water droplets and water vapor. Moreover, since a smooth surface is obtained, a recorded image with high glossiness and high density can be produced. By improving the materials, it is possible to form recording media which enable recording with long-term preservability, such as excellent water resistance, weatherability with respect to light, gas, etc., and wear resistance.

When recording is performed using the back print film, dye ink is ejected on the porous layer at the front to produce a back-side image so that the recorded image is viewed from the base side at the back. Consequently, even if the conventional double-side printing method is used, it is not possible to produce images (front-side image and back-side image) which are viewed from the front and back sides of the recording medium, respectively.

SUMMARY OF THE INVENTION

It is an object of the present invention to provide an ink jet recording apparatus and ink jet recording method in which images viewable from both sides of a recording medium can be recorded with an extremely simple structure without requiring the step carried out in the conventional double-side recording, i.e., the step of ejecting inks on both sides of the recording medium by reversing the recording medium.

In one aspect of the present invention, in an ink jet recording method using a recording head capable of ejecting a first ink containing a coloring material with a relatively small particle size $\phi d$ and a second ink containing a coloring material with a relatively large particle size $\phi p$, the first ink and the second ink being ejected to the same side of a recording medium, the method includes the steps of:

selecting a specific recording medium including a porous layer and a base or a recording medium other than the specific recording medium as the recording medium used for recording; and when the specific recording medium is selected, ejecting the first ink from the recording head to the porous layer and then ejecting the second ink from the recording head to the porous layer, while relatively moving the recording medium and the recording head, wherein the porous layer has a gap size $\phi h$ that is larger than the particle size $\phi d$ of the coloring material of the first ink and smaller than the particle size $\phi p$ of the coloring material of the second ink.

In another aspect of the present invention, in an ink jet recording method using a recording head capable of ejecting a first ink containing a coloring material with a relatively small particle size and a second ink containing a coloring material with a relatively large particle size, the first ink and the second ink being ejected to the same side of a recording medium, the method includes the step of:

ejecting the first ink from the recording head to a region of a first side of the recording medium and then ejecting the second ink from the recording head to the region of the first side, while relatively moving the recording medium and the recording head, wherein an image recorded with the first ink is formed on a second side of the recording medium opposite to the first side, and an image recorded with the second ink is formed on the first side.

In another aspect of the present invention, in an ink jet recording method using a recording head capable of ejecting a first ink containing a coloring material with a relatively small particle size and a second ink containing a coloring material with a relatively large particle size, the first ink and the second ink being ejected to the same side of a recording medium, the method includes the step of:

ejecting the first ink from the recording head to the recording medium and then ejecting the second ink from the recording head to the recording medium, while relatively moving the recording medium and the recording head, wherein the first ink is ejected based on mirror data corresponding to a mirror image of the image to be recorded, and the second ink is ejected based on data corresponding to the image to be recorded.

In another aspect of the present invention, an ink jet recording apparatus is capable of performing any one of the ink jet recording methods described above.

In accordance with the present invention, when recording is performed by ejecting a first ink (containing a coloring material with a relatively small particle size) and a second ink (containing a coloring material with a relatively large particle size) to the same side of a recording medium, the first ink is ejected first and then the second ink is ejected to a region including the region in which the first ink has been ejected. An image recorded with the first ink is viewed from a side opposite to the side to which the ink is ejected, and an image recorded with the second ink is viewed from the side to which the ink is ejected. Consequently, for example, while the recording medium is transported, only by ejecting the first ink and the second ink to the same side of the recording medium, images viewable from both sides (back-side image and front-side image) can be formed.

Further objects, features and advantages of the present invention will become apparent from the following description of the preferred embodiments with reference to the attached drawings.

DESCRIPTION OF THE PREFERRED EMBODIMENTS

The embodiments of the present invention will be described in detail with reference to the drawings.

In this specification, "double-side recording" is defined as recording in which by ejecting a first ink and a second ink containing coloring materials which at least have different particles sizes to the same side of a recording medium so as to produce images viewable from both sides of the recording medium (back-side image and front-side image). More particularly, an image recorded with the first ink is defined as the back-side image viewed from the back side of the recording medium, and an image recorded with the second ink is defined as the front-side image viewed from the front side of the recording medium.

As described above, in the "double-side recording" technique of the present invention, recording is performed on both sides of a recording medium by ejecting inks on the same side of the recording medium. The spirit of the present invention is completely different from that of the conventional double-side recording technique in which inks are ejected on both sides of a recording medium.

In this specification, a side on which inks are ejected is defined as a "front side of a recording medium", and the opposite side is defined as a "back side of the recording medium".

Figure 1:
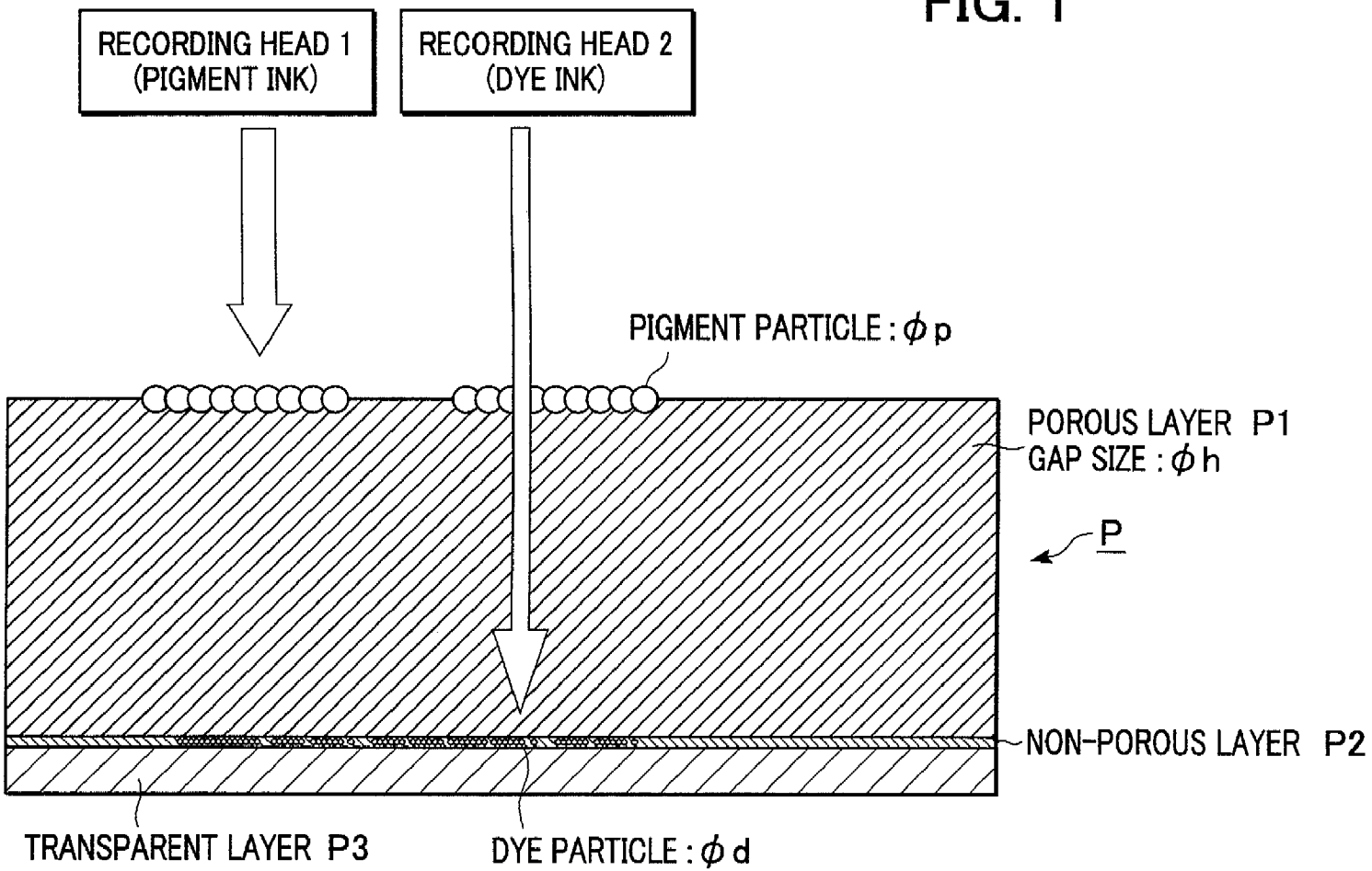
FIG. 1 is a schematic diagram which shows double-side recording according to the present invention.

FIG. 1 is a schematic diagram which shows double-side recording in an embodiment of the present invention. As shown in FIG. 1, a recording head 1 and a recording head 2 which eject inks containing coloring materials with different particle sizes are used. More specifically, the recording head 1 ejects a second ink having a particle size $\phi p$, and the recording head 2 ejects a first ink having a particle size $\phi d$. In this specification, a particle size is defined as an average particle size of particles constituting an ink. A case in which a pigment is used as the coloring material of the second ink and a dye is used as the coloring material of the first ink will be described below. However, it is to be understood that the present invention is not limited thereto. That is, in the present invention, the particle size $\phi p$ of the coloring material of the second ink must be larger than the particle size $\phi d$ of the coloring material of the first ink. Therefore, if this relationship is satisfied, the coloring materials of the first ink and the second ink may both be pigments.

Along with the first ink and the second ink, a recording medium P is used, the recording medium P being a back print film (hereinafter also abbreviated as BPF) including a porous layer P1 having a gap size $\phi h$ that is larger than the particle size $\phi d$ and smaller than the particle size $\phi p$. The gap size is defined as an average gap size of gaps in the porous layer. That is, inks and a recording medium which satisfy the relationship $\phi d<\phi h<\phi p$ are used.

After the dye ink having a smaller particle size is ejected, the pigment ink having a larger particle size is ejected. The dye which is the coloring material of the dye ink ejected first passes through the porous layer P1 and reaches a non-porous layer P2, and thereby is held by the non-porous layer P2 to form an image (back-side image). The back-side image is viewed through a transparent layer (base) P3 at the side opposite to the recording side on which the ink is ejected. The pigment ink ejected later does not pass through the porous layer P1 due to its particle size and fixes on the surface of the porous layer P1. Thereby, an image (front-side image) is formed with the pigment ink. This image is viewed from the recording side.

More specifically, a recording medium in the BPF form is used, and a dye ink is ejected from the recording side based on mirror image data. Subsequently, a pigment ink is ejected from the same recording side based on ordinary image data which is not mirrored. Consequently, when viewed from the side opposite to the recording side, the image (back-side image) mainly composed of the dye held by the non-porous layer P2 can be viewed as the original image not mirrored. When viewed from the recording side, the image (front-side image) mainly composed of the pigment held by the porous layer P1 can be viewed as the original image.

First Embodiment

A recording medium used in a first embodiment of the present invention is in the BPF form described above and includes a base which is a transparent layer, a non-porous layer disposed on the base, and a porous layer disposed on the non-porous layer.

As the base, any known material may be used. Specific examples thereof include plastic films or sheets, such as films or sheets of polyester resins, diacetate resins, triacetate resins, polystyrene resins, polyethylene resins, polycarbonate resins, polymethacrylate resins, cellophane, Celluloid, poly(vinyl chloride) resins, and polyimide resins; and glass sheets.

As described above, the base must be transparent. The base may be processed in any way as long as the transparency is not impaired, and for example, desired patterns and glosses (moderate glosses, matt finishes, etc.) may be provided on the base. Furthermore, water resistance, abrasion resistance, and anti-blocking properties may be imparted to the base.

The thickness of the base is not particularly limited, but is generally 1 to 5,000 μm, preferably 3 to 1,000 μm, and more preferably 5 to 500 μm.

The porous layer must have permeability to liquid. Herein, the permeability to liquid is defined as a property which rapidly passes the dye ink (more specifically, dye particles with a particle size ϕd) and does not substantially retain the dye particles in the porous layer. In order to improve permeability to liquid, preferably, the porous layer has a porous structure including cracks and communicating pores.

Preferably, the porous layer has a light scattering property so that the image recorded with the dye ink (back-side image) is viewed from the side opposite to the recording side. For example, when recording is performed using an aqueous ink, porous layers with the following structures may be used.

(1) A porous layer composed of resin fine particles, a binder, etc., and having cracks inside.
(2) A porous layer formed by a technique in which a second material is dispersed in a film and a porous state is generated by treatment with a solvent.
(3) A porous layer formed by a technique in which a resin is dispersed in a mixed solvent and the high boiling point solvent, which is a poor solvent for the resin, generates a porous state.
(4) A porous layer formed by a technique in which a porous state is generated by incorporation of an expandable material during the film formation.

Additionally, all the materials used must have a non-dyeing property to solvents and water in inks.

The porous layer with the structure (1) composed of resin particles and a binder will be described in detail below.

As the resin particles, organic pigments, such as thermoplastic resins and thermosetting resins, which are non-adsorptive to dye particles, may be used. Examples thereof include polystyrene, elastomers, ethylene-vinyl acetate copolymers, styrene-acrylic copolymers, polyesters, poly (meth)acrylic acid, poly(meth)acrylate esters, polyvinyl ethers, polyamides, polyolefins, polyimides, guanamine, SBR, NBR, MBS, polytetrafluoroethylene, urea-formalin resins, polyvinyl chloride, polyacrylamide, and chloroprene. These resins may be used alone or in combination, and in the form of powder, emulsion, or suspension.

In order to improve the whiteness degree (light scattering property) of the porous layer, a white inorganic pigment may be added in such an amount that does not inhibit the ink-permeability of the porous layer. Examples of the white inorganic pigment include talc, calcium carbonate, calcium sulfate, magnesium hydroxide, basic magnesium carbonate, alumina, synthetic silica, calcium silicate, diatomaceous earth, aluminum hydroxide, clay, barium sulfate, titanium oxide, zinc oxide, zinc sulfide, satin white, silicon oxide, and lithopone.

The resin particles which may be used are not limited to those described above. Any known material may be acceptable as long as it is non-adsorptive to the recording agent.

The binder which is used in the structure (1) has a function of binding the resin particles together and/or the resin particles and the non-porous layer to each other, and is desirably non-adsorptive to the recording agent. Any known material having such a function may be used. Preferred examples thereof include poly(vinyl alcohol), acrylic resins, styrene-acrylic copolymers, poly(vinyl acetate), ethylene-vinyl acetate copolymers, starch, poly(vinyl butyral), gelatin, casein, ionomers, gum arabic, carboxymethyl cellulose, poly(vinyl pyrrolidone), polyacrylamide, polyurethanes, phenol resins, melamine resins, epoxy resins, styrene-butadiene rubber, urea, α-olefins, chloroprene, and nitrile rubber. These resins may be used alone or in combination.

When a porous layer having a heat fusion property or pressure fusion property is used, after an image is generated, by applying heat or pressure while the porous layer is in close contact with the surface of the base composed of a metal or plastic, it is possible to easily form the image on the base.

Furthermore, in order to improve the function of the porous layer, various additives, such as surfactants, penetrants, and crosslinking agents, may be incorporated into the porous layer, as necessary.

The mixing ratio (by weight) of the resin particles to the binder is preferably 1:2 to 50:1 and more preferably 3:1 to 20:1.

If the mixing ratio is less than 1:2, the size of gaps, such as cracks and communicating pores, of the porous layer is decreased, resulting in a decrease in the absorption of the dye particles. If the mixing ratio exceeds 50:1, bonding between the resin particles or bonding between the non-porous layer and the resin particles becomes unsatisfactory, and it is not possible to form a porous layer. The thickness of the porous layer, which depends on the amounts of inks applied, is preferably 1 to 200 μm and more preferably 3 to 50 μm.

Desirably, the non-porous layer constituting the recording medium in this embodiment is more dye-absorbent than the porous layer in order to stably absorb and retain the ink temporarily absorbed by the porous layer. Therefore, the non-porous layer must have a high affinity for the dye as well as for the ink solvent. If the absorbency of the non-porous layer is weaker than that of the porous layer, when the dye ink applied to the surface of the porous layer passes through the porous layer and when the leading end of the dye ink reaches the non-porous layer, the dye remains in the porous layer. The dye spreads and diffuses more than necessary at the interface between the porous layer and the non-porous layer. As a result, the resolution of the recorded image is decreased, and it becomes impossible to form a high-quality recorded image.

Desirably, the non-porous layer which satisfies the requirements described above is mainly composed of a light-transmitting resin which adsorbs the recording agent and which has solubility and a swelling property with respect to ink. For example, when an aqueous ink containing an acid dye or direct dye is used as the recording agent, the non-porous layer is preferably composed of a water-soluble or hydrophilic polymer which is absorbent to such a dye and which has a swelling property with respect to the aqueous ink.

Examples of the water-soluble or hydrophilic polymer include natural resins, such as albumin, gelatin, casein, starch, cation starch, gum arabic, and sodium alginate; and synthetic resins, such as carboxymethyl cellulose, hydroxyethyl cellulose, polyamides, polyacrylamide, polyethyleneimine, poly(vinyl pyrrolidone), quaternized poly(vinyl pyrrolidone), polyvinylpyridinium halides, melamine resins, phenol resins, alkyd resins, polyurethanes, acetal-modified poly(vinyl alcohol), poly(vinyl alcohol), ionically modified poly(vinyl alcohol), polyesters, and sodium polyacrylate. Preferred examples include hydrophilic polymers which are made water-insoluble by crosslinking of these polymers, hydrophilic and water-insoluble polymer complexes including two or more polymers, and hydrophilic and water-insoluble polymers having hydrophilic segments.

The thickness of the non-porous layer is preferably 1 to 30 μm and more preferably 3 to 10 μm.

In order to form the non-porous layer and the porous layer on the base, coating liquids are prepared by dissolving or dispersing suitable materials in appropriate solvents, and then the coating liquids are applied to the surface of the base by a known method, such as roll coating, blade coating, air-knife coating, gate-roll coating, bar coating, size pressing, sym-sizer coating, spray coating, gravure coating, or curtain coating. Furthermore, in order to smooth the surface or enhance the strength of the surface, supercalendering may be performed.

Figure 2:
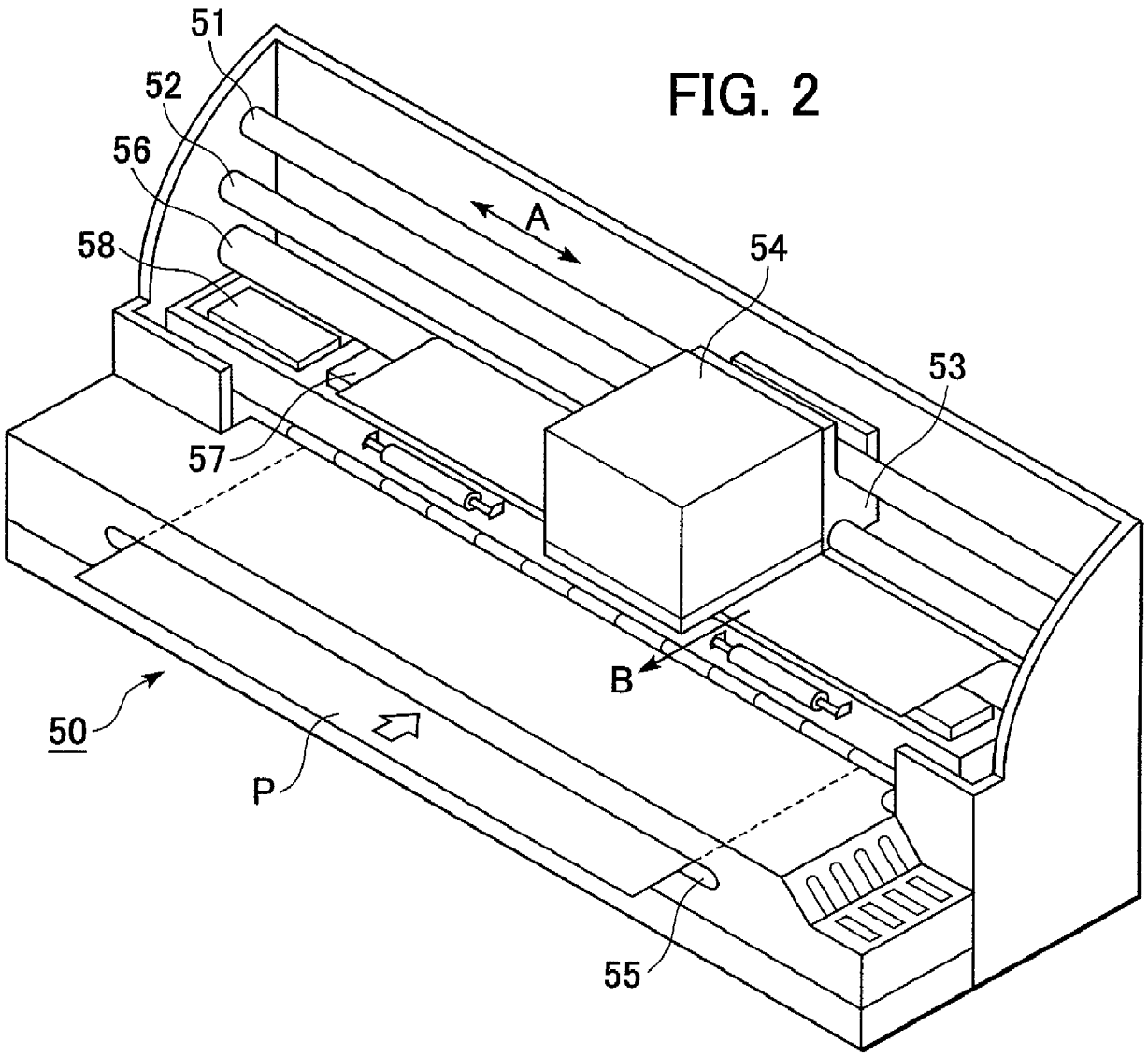
FIG. 2 is a perspective view which schematically shows an ink jet recording apparatus in a first embodiment of the present invention.

FIG. 2 is a perspective view which schematically shows an ink jet recording apparatus in the first embodiment of the present invention. A recording apparatus 50 is a serial scanning type apparatus. A carriage 53 is guided by guide shafts 51 and 52 so as to be movable in the horizontal scanning direction indicated by arrow A. The carriage 53 is reciprocated in the horizontal scanning direction by a carriage motor and a driving force transmission device including belts, etc.

Recording heads (not shown in FIG. 2) and an ink tank 54 for supplying inks to the recording heads are mounted on the carriage 53. More specifically, as described below with reference to FIG. 4, recording heads which eject black (Bk), yellow (Y), magenta (M), and cyan (C) inks, respectively, are detachably mounted on the carriage 53.

A recording sheet P which is a BPF is inserted from a feed slot 55 provided on the front end of the apparatus. The transporting direction of the sheet is then reversed, and the sheet P is transported by a feed roller 56 in the vertical scanning direction indicated by arrow B. In the recording apparatus 50, a recording operation in which ink is ejected toward the printing region of the sheet P on a platen 57 while moving the recording heads in the horizontal scanning direction and a transporting operation in which the sheet P is transported in the vertical scanning direction by the array width of ejection ports of the recording heads are repeatedly performed. Thereby, images are sequentially recorded.

As shown in FIG. 2, a recovery unit (recovery processing device) 58 is provided on the left end in the carriage moving region so as to face the ejection port side of the recording heads mounted on the carriage 53. The recovery unit 58 includes caps capable of capping the ejection ports of the individual recording heads, and a suction pump capable of applying a negative pressure to inside of the caps, etc. By applying the negative pressure to inside of the caps, inks are discharged from the ejection ports by suction, and thus a recovery process (also referred to as a "suction recovery process") is performed in order to maintain the satisfactory ink ejection state at the recording heads. Additionally, by allowing inks which do not contribute to the recording operation to eject from the ejection ports toward inside of the caps, a recovery process (also referred to as a "preliminary ejection") may be performed.

Figure 3:
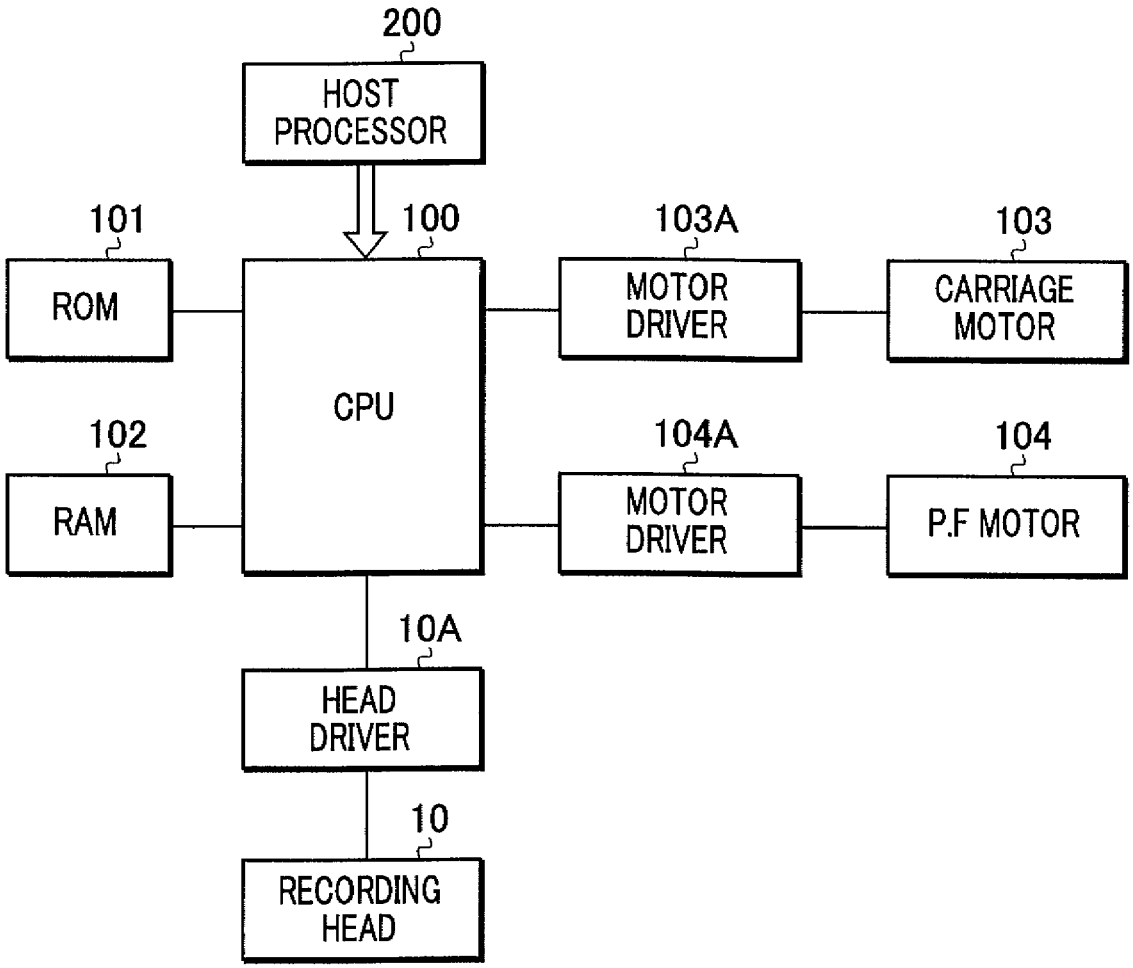
FIG. 3 is a block diagram which shows a schematic structure of a control system of the recording apparatus.

FIG. 3 is a block diagram which shows a schematic structure of a control system of the recording apparatus described above. Referring to FIG. 3, CPU 100 controls processing for the operation of the recording apparatus and data processing. ROM 101 stores the programs for processing procedures, etc., and RAM 102 is used as a work area for carrying out such processes. Ejection of inks from recording heads 10 for Bk, Y, M, and C inks are performed by the CPU 100 process in which driving data (image data) of heating elements provided on ink passages communicating with the individual ejection ports of the recording heads and drive control signals (heat pulse signals) are supplied to a head driver 10A. The CPU 100 also controls a carriage motor 103 for driving the carriage 53 in the horizontal scanning direction through a motor driver 103A and controls a P. F motor 104 for transporting the sheet P in the vertical scanning direction through a motor driver 104A.

Figure 4:
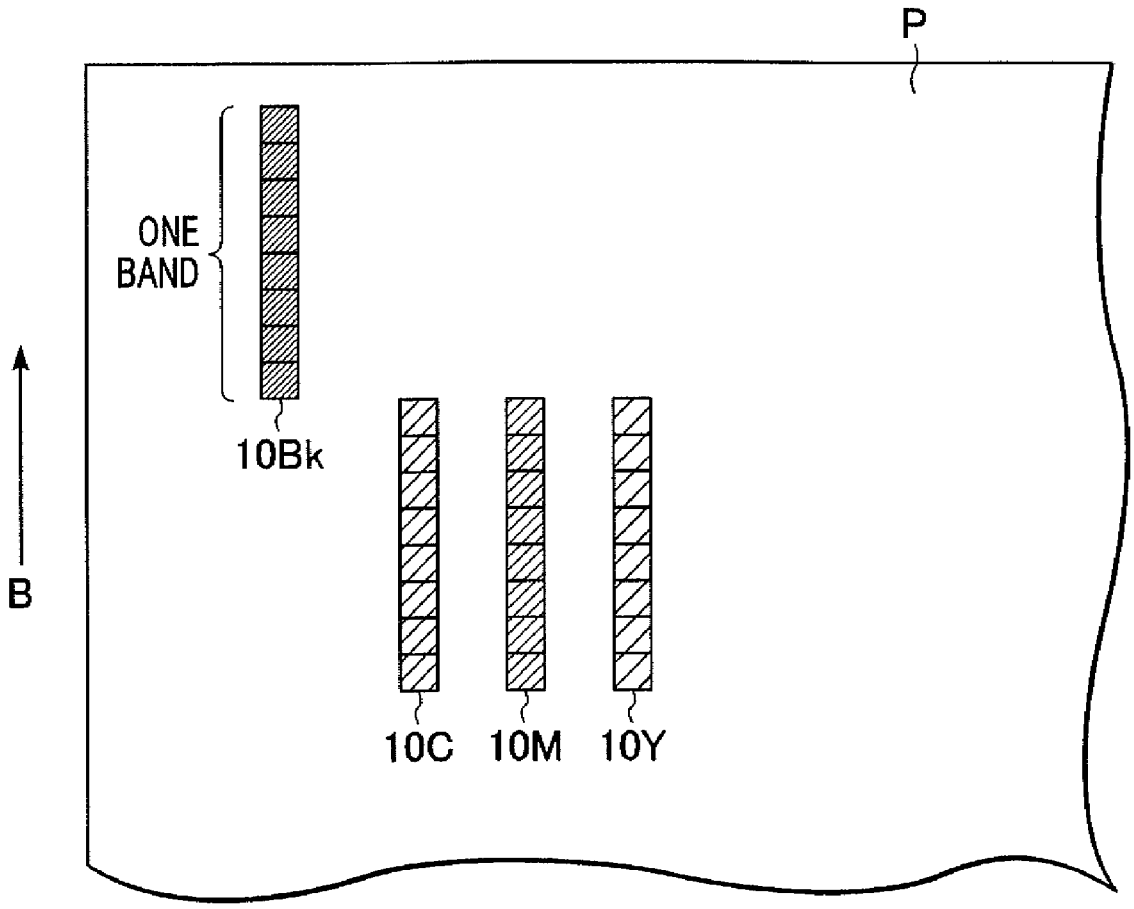
FIG. 4 is a schematic diagram which shows the recording heads and their positional relationship in an ink jet recording apparatus in the first embodiment of the present invention.

FIG. 4 is a schematic diagram which shows the positional relationship of the recording heads used in the ink jet recording apparatus described above. FIG. 4 shows the ejection ports of the recording heads which are arrayed facing the sheet P.

As shown in FIG. 4, in this embodiment, a recording head 10Bk which ejects a black (Bk) ink and recording heads 10C, 10M, and 10Y which eject cyan (C), magenta (M), and yellow (Y) inks, respectively, are mounted on the carriage 53. The position of the recording head 10Bk is shifted from that of the recording heads 10C, 10M, and 10Y in the transporting direction B of the sheet P by the array width of the ejection ports of the recording heads.

The C, M, and Y inks include dyes as the coloring materials. Each dye has a particle size $\phi d$ of 1 to 3 nm. Each ink readily permeates through the recording medium with a surface tension of 30 dyn and a viscosity of 2.0 cp. Because of such physical properties, when these inks are ejected to the recording side of the sheet P, the inks (dye particles of the C, M, and Y inks) pass through the porous layer with a gap size $\phi h$ of 10 to 30 nm which is larger than the particle size $\phi d$ and reach the non-porous layer to form an image.

On the other hand, the Bk ink includes a pigment as the coloring material. The pigment has a particle size ϕp of 30 to 100 nm. The ink does not readily permeate through the recording medium with a surface tension of 40 dyn and a viscosity of 2.4 cp. Because of such physical properties, when the Bk ink is ejected to the recording side of the sheet P, the Bk ink (pigment particles of the Bk ink) does not penetrate into the porous layer with the gap size ϕh which is smaller than the particle size ϕp and fixes on the recording side of the sheet P to form an image of the Bk ink.

Each of the recording heads 10C, 10M, and 10Y includes 128 ejection ports at a density of 600 dpi, the ejection ports being arrayed in the transport direction B of the sheet P. Each ejection port ejects 15 pl of ink. On the other hand, the recording head 10Bk includes 128 ejection ports at a density of 600 dpi, the ejection ports being similarly arrayed in the transport direction B. Each ejection port ejects 30 pl of ink.

As described above, the position of the recording head 10Bk is shifted from that of the recording heads 10C, 10M, and 10Y in the transporting direction B of the sheet P by the array width of the ejection ports of the recording heads. The amount of the transport of the sheet P is set at the array width of the ejection ports, i.e., one band with respect to scanning of the recording heads. Consequently, in this embodiment, although scanning is performed simultaneously by the recording head 10Bk and the recording heads 10C, 10M, and 10Y, different regions are scanned. Since the sheet P is transported by one band between the scans, ejection is performed by the recording head 10Bk later, at an interval of about one scan, on the recording side on which ejections have been performed first by scanning with the recording heads 10C, 10M, and 10Y.

Consequently, as described above, the dye inks of C, M, and Y ejected first move from the recording side into the inner layer before the pigment Bk ink is ejected and finally reach the non-porous layer. The dye particles are held by the non-porous layer, and thereby an image of C, M, and Y is formed. That is, the relationship between the gap size ϕh of the porous layer and the dye particle size ϕd is set so that the dye particles of C, M, and Y inks ejected at least move from the recording side into the inner layer during an interval of about one scan and do not remain on the recording side. On the other hand, since the pigment particle size ϕp of the Bk ink is set to be larger than the gap size ϕh of the porous layer, the pigment forms an image of Bk on the recording side.

Double-side recording according to this embodiment is specifically used, for example, for recording a New Year's postcard in which a color image is recorded on the back side which is the base side, and black characters, such as those for addresses, are recorded on the front side which is the recording side. In such a case, by transporting a recording sheet P of a postcard size only in the B direction in the recording apparatus, recording can be performed on both sides. With respect to the mounting structure of recording heads, the recording head which ejects the pigment Bk ink is shifted from the recording heads which eject other color dye inks only by the array width of the ejection ports. Thereby, it is possible to perform double-side recording with a simple structure which does not substantially differ from the conventional ink-jet recording apparatus.

In this embodiment, the time difference between the ejection of the C, M, and Y dye inks and the ejection of the Bk pigment ink is set at an interval of about one scan. However, the time difference may be set at an interval of more than one scan depending on the permeation period of the dye inks ejected first. In such a case, for example, if the position of the recording heads for the dye inks is shifted from the position of the recording head for the pigment ink by two bands, the time difference will be an interval of about two scans.

Figure 5:
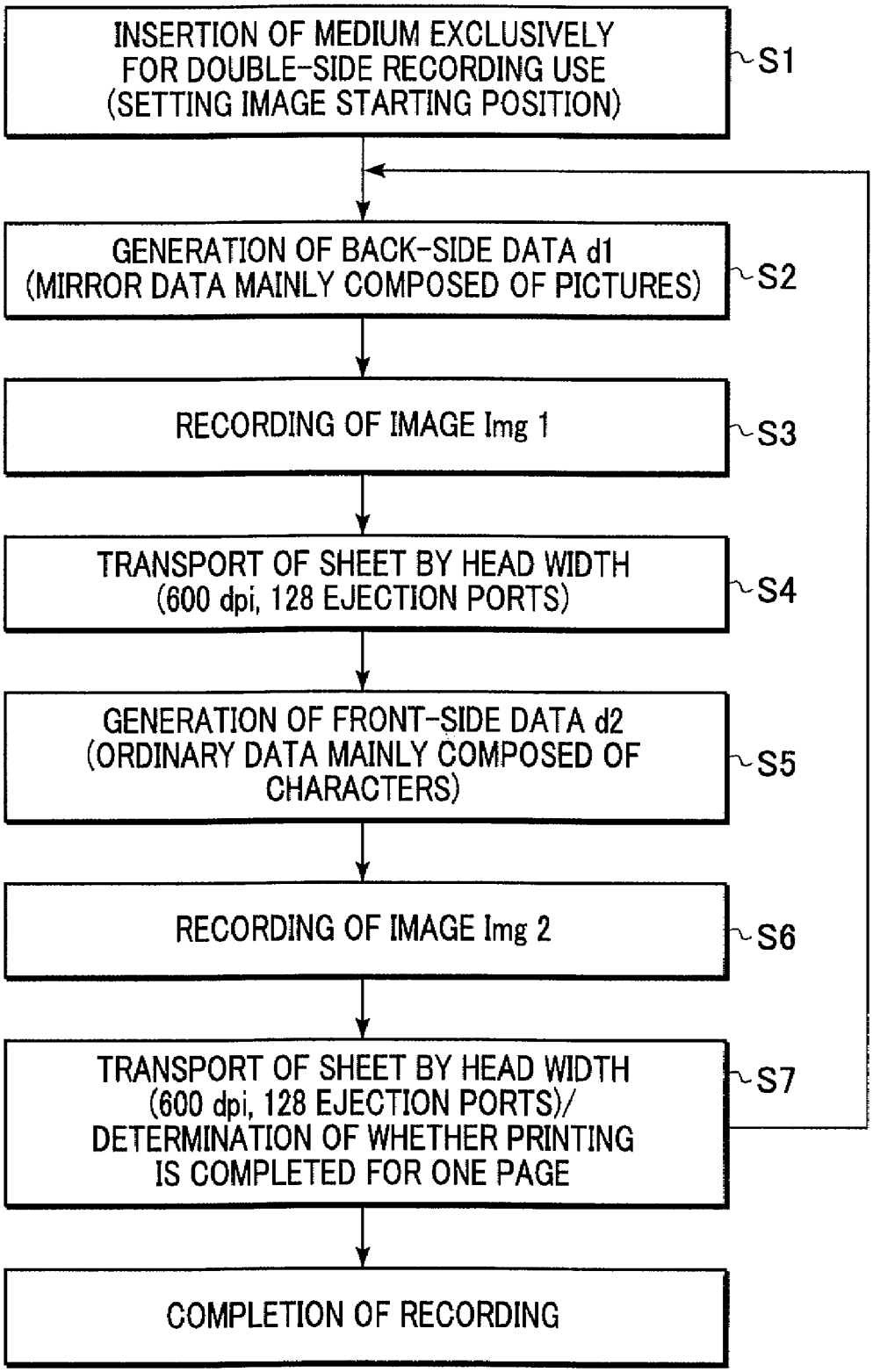
FIG. 5 is a flowchart which shows the recording process in the first embodiment of the present invention.

FIG. 5 is a flowchart which shows the recording process in the first embodiment described above. This flowchart shows the recording process with respect to one region corresponding to one band, and using the arrangement of the recording heads shown in FIG. 4, the recording processes are simultaneously performed in two regions and two images are recorded alternately.

Referring to FIG. 5, first, in Step S1, a recording medium P is inserted into a feed slot 55 of the apparatus so that the recording side, i.e., the porous layer side, of the sheet P is placed as the upper side in the scanning region of the recording heads.

In Step S2, as the step of first recording, ejection data dl of C, M, and Y which forms an image viewed from the side opposite to the recording side is generated. Since the ejection data dl forms the image viewed from the base side at the back, mirroring is performed so that mirror data corresponding to a mirror image of the image to be recorded is obtained. Next, in Step S3, while scanning with the recording heads is carried out, one band of the generated ejection data dl is sent to the driver 10A for the recording heads 10C, 1M, and 10Y and the C, M, and Y inks are ejected. As described above, these inks pass through the porous layer to reach the non-porous layer, and an image Img 1 (back-side image) is formed. In Step S4, the sheet P is transported by one band.

In Step S5, as the step of second recording, ejection data d2 of Bk which forms an image viewed from the recording side of the sheet P is generated. Since the pigment forming the image remains on the upper surface of the porous layer and the image is viewed from the recording side on which the Bk ink has been ejected as in the conventional recording, mirroring is not performed. In Step S6, while scanning of the recording head 10Bk is carried out, one band (corresponding to the array width of the ejection ports of the recording head 10Bk) of the generated ejection data d2 is sent to the driver 10A for the recording head 10Bk, and an image Img 2 (front-side image), such as black characters, is formed with the Bk pigment ink.

By the process described above, the image Img 2 and the image Img 1 are formed on the front and back sides of the sheet P in the regions corresponding to one band. At this stage, in the adjacent region upstream corresponding to one band, if it has been determined that data to be recorded still exists in Step S7, the Img 1 is simultaneously formed with the C, M, and Y dye inks.

That is, as the formation of the Bk image is completed, in Step S7, the sheet P is transported as in Step S4, and it is determined whether data to be recorded for the page still exists or not. When it is determined that data to be recorded still exists, the process described above is repeated back from Step S2. On the other hand, if it is determined that recording for one page is completed, this process is finished.

By the recording process described above, the image Img 1, such as a photo-like image, is viewed from the back side (transparent base side), and the image Img 2, such as characters, is viewed from the front side (recording side).

In the embodiment described above, ejection data of the individual images Img 1 and Img 2 is generated by the recording apparatus. However, the ejection data may be generated by a host computer, for example, as bitmap data. In such a case, the recording apparatus processes the data sent from the host computer in Steps S2 and S5, respectively, for each band.

Figure 6:
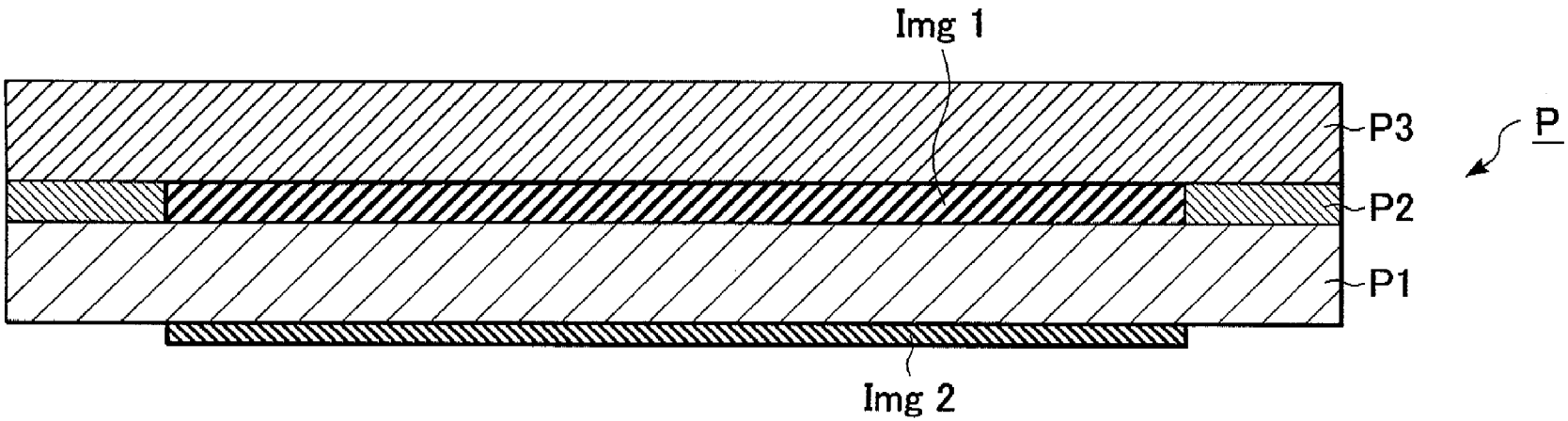
FIG. 6 is a sectional view of a recording sheet on which recording has been performed in accordance with the recording process shown in FIG. 5.

FIG. 6 is a sectional view of the recording sheet P on which recording has been performed as described above. As shown in FIG. 6, the image Img 1 and the image Img 2 can be recorded on overlapping regions so as to be viewed from different sides. Moreover, recording can be performed by scanning the same recording side with the respective recording heads. As a result, double-side recording can be performed with a relatively simple structure and for a shorter period of time compared with the conventional apparatus.

In the embodiment described above, one band is recorded by one pass, i.e., by one scan. However, a known recording method, such as a so-called multi-pass recording method, may also be used, in which one line composed of ink dots formed by scanning with a recording head is formed by the ink ejected from a plurality of different ejection ports of the recording head by conducting a plurality of runs of scanning. In such a case, as long as the formation order of the images Img 1 and Img 2 is not reversed, various types of multi-pass recording can be performed. For example, when the image Img 2 to be recorded later is recorded, if the image Img 1 recorded first has penetrated into the sheet, it is possible to form the image Img 2 without changing scanning. Supposing that the formation order is reversed, in the region in which a layer of the pigment ink for the image Img 2 is formed, permeation of the ink for the image Img 1 will not be performed normally, resulting in an irregular image, such as unrecorded spots.

For example, if both of the images Img 1 and 2 are formed with (a) dye inks (having particle sizes smaller than the gap size $\phi h$ of the recording medium) or (b) pigment inks (having particle sizes larger than the gap size $\phi h$ of the recording medium), double-side recording is not enabled. In the case of (a), all the inks pass through the porous layer to the side opposite to the recording side, and the images Img 1 and Img 2 are mixed. Similarly, in the case of (b), all the inks remain on the recording side, and the images Img 1 and Img 2 are mixed.

Consequently, when images are formed on both sides using ordinary inks without any reaction, at least the following relationship is required between the particle size $\phi d$ of a first ink for forming the back-side image, the particle size $\phi p$ of a second ink remaining on the recording side, and the gap size $\phi h$ of the recording medium:

$$\phi d<\phi h<\phi p$$

Second Embodiment

Figure 7:
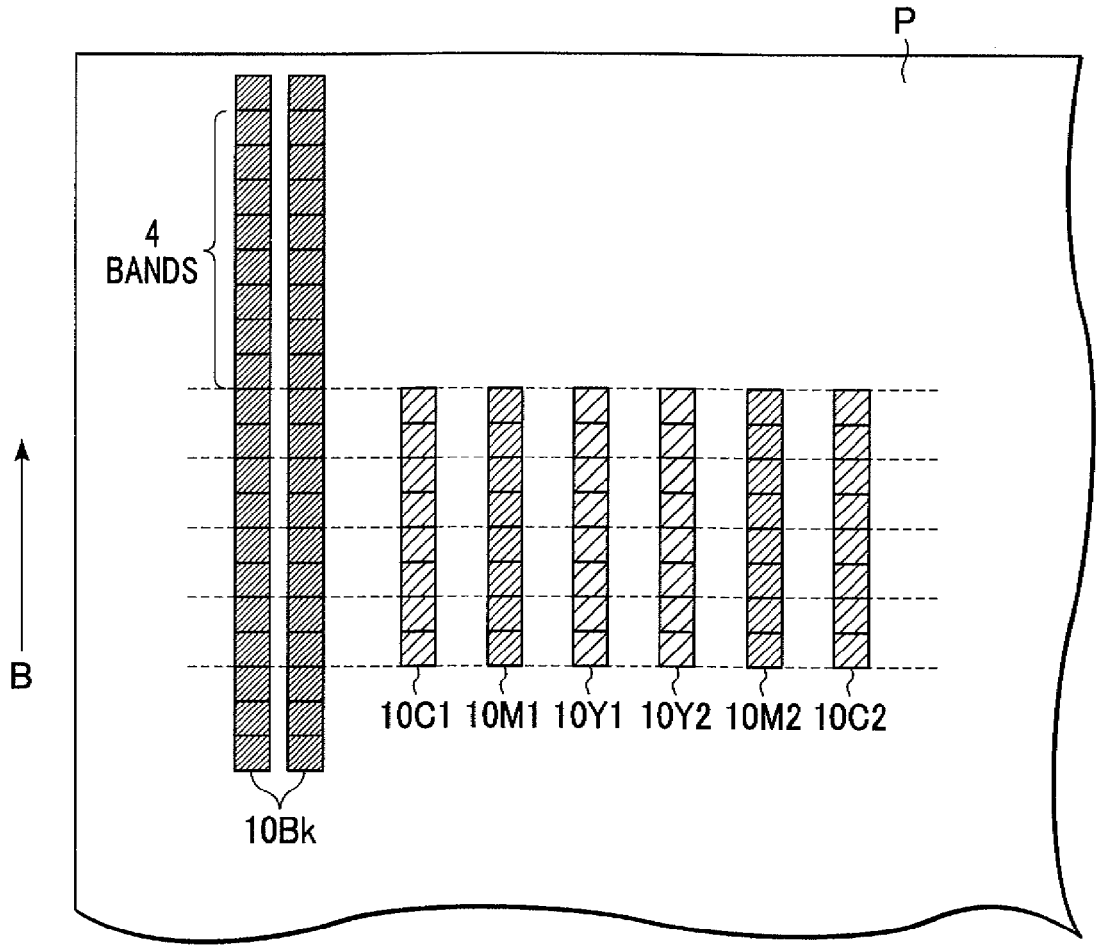
FIG. 7 is a schematic diagram which shows the recording heads for the individual inks and their positional relationship in a second embodiment of the present invention.

FIG. 7 is a schematic diagram which shows the recording heads for the individual inks and their positional relationship in a second embodiment of the present invention.

In this embodiment, each of C, M, and Y dye inks is ejected by two recording heads. That is, recording heads 10C1, 10M1, 10Y1, 10Y2, 10M2, and 10C2 are arrayed in that order such that the recording heads for the individual colors are symmetrically placed. When bidirectional recording is performed, the recording heads 10C1, 10M1, and 10Y1 are used for scanning in one direction, and the recording heads 10Y2, 10M2, and 10C2 are used for scanning in the other direction. Thereby, the individual colors can be overlapped in the same manner by such bidirectional recording. This prevents the color from differing depending on the scanning direction. These recording heads for C, M, and Y eject inks which readily permeate through the recording medium, the same as those described in the first embodiment. Each recording head includes 256 ejection ports at a density of 1,200 dpi. Each ejection port ejects 5 pl of ink.

On the other had, a recording head 10Bk for ejecting a Bk pigment ink has two ejection port lines, and each ejection port line includes 160 ejection ports at a density of 300 dpi. The ejection ports arrayed in one line are shifted by one half pitch from the ejection ports arrayed in the other line. Thereby, in the entire recording head 10Bk, 320 ejection ports are arrayed at a density of 600 dpi. Each ejection port ejects 30 pl of ink. The ink ejected does not readily permeate through the recording medium.

As shown in FIG. 7, the recording head 10Bk has a larger array width of the ejection ports than the array width of the ejection ports of each of the recording heads 10C1, 10M1, 10Y1, 10Y2, 10M2, and 10C2. The recording head 10Bk is shifted from the other recording heads by more than 4 bands, which correspond to the array width of the ejection ports of the other recording heads, downstream in the transporting direction of the sheet. Herein, one band corresponds to one unit of recording in multi-pass (4-pass) recording.

In this embodiment, in addition to the double-side recording mode to which the present invention is applied, for example, a single-side recording mode in which only a black head Bk for ejecting a pigment ink is used and a single-side recording mode in which only color heads for ejecting C, M, and Y dye inks are used are also enabled.

The single-side recording modes can be classified into two major types. In one single-side recording mode, recording is performed using a pigment ink only. In the other single-side recording mode, recording is performed using dye inks only. When the pigment ink only is used, only an image viewed from the recording side of the recording medium (front-side image) is obtained, and a back-side image is not obtained. In such a case, preferably, recording is performed in one unidirectional or bidirectional scan using all the ejection ports of the recording head 10Bk. On the other hand, when only the dye inks are used, only an image viewed from the side opposite to the recording side of the recording medium (back-side image) is obtained, and a front-side image is not obtained. In such a case, preferably, bidirectional recording is performed. More specifically, preferably, the recording heads 10C1, 10M1, and 10Y1 are used for forward scanning and the recording heads 10Y2, 10M2, and 10C2 are used for backward scanning.

In the double-side recording mode, only the recording heads 10C1, etc., for color inks and the ejection ports corresponding to 4 bands of the recording head 10Bk placed downstream are used.

In this embodiment, the relationship $\phi d<\phi h<\phi p$ is also satisfied. That is, the gap size of the recording medium used is about 20 nm. Each of the C, M, and Y dye inks has a surface tension of 30 dyn, a viscosity of 2.0 cp, and a particle size $\phi d$ of about 2 nm. The Bk pigment ink has a surface tension of 40 dyn, a viscosity of 2.2 cp, and a particle size $\phi p$ of about 60 nm.

The double-side recording mode is executed by bidirectional recording by the color recording heads 10C1, etc., and unidirectional recording by the recording head 10Bk. The bidirectional recording by the recording heads 10C1, etc., are carried out as multi-pass (4-pass) recording.

Figure 8:
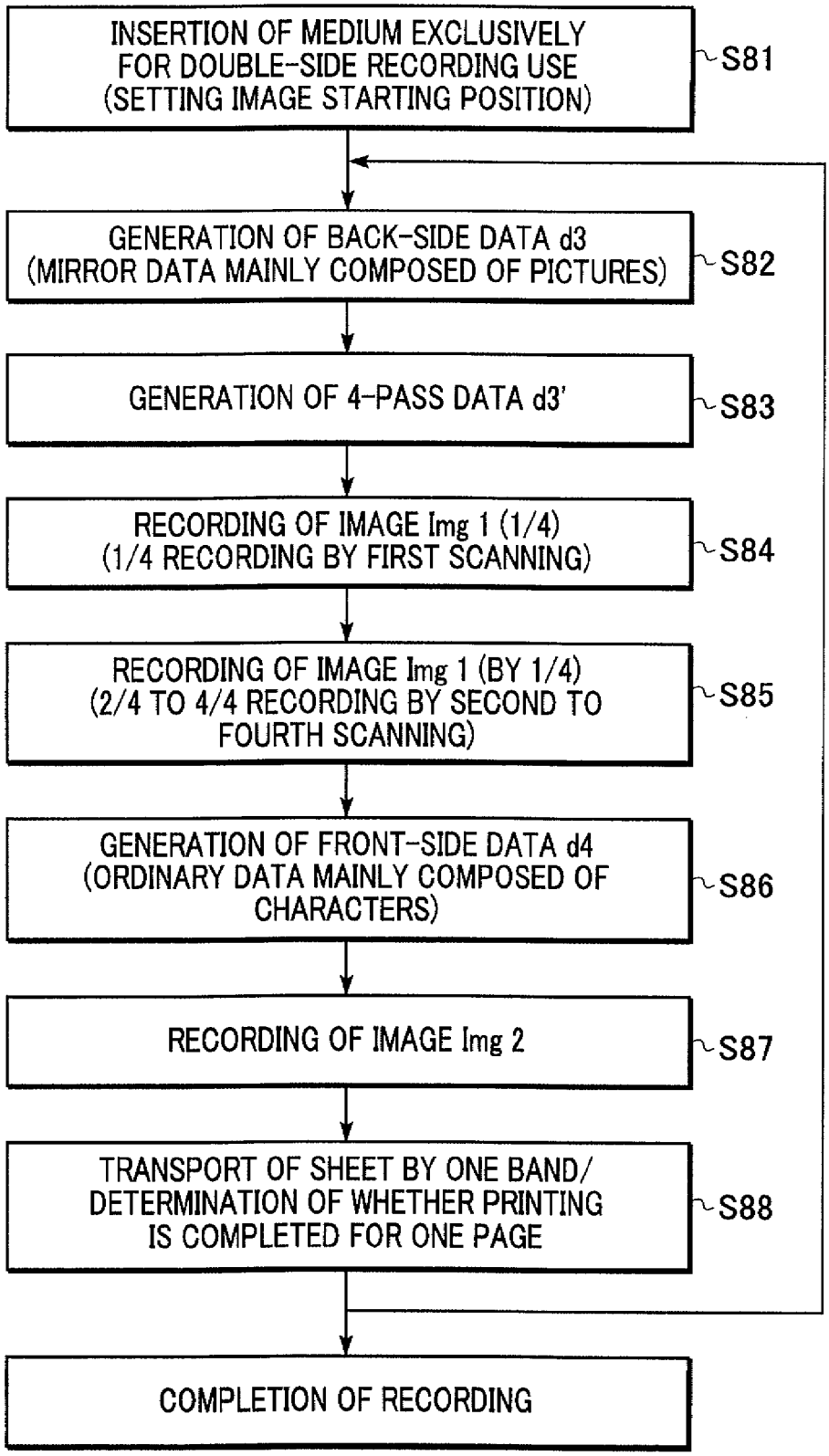
FIG. 8 is a flowchart which shows the recording process in the double-side recording mode in the second embodiment of the present invention.

FIG. 8 is a flowchart which shows the recording process in the double-side recording mode in this embodiment, which is similar to the process shown in FIG. 5 in the first embodiment.

Referring to FIG. 8, first, in Step S81, a recording sheet P is inserted into a feed slot 55 (refer to FIG. 2) as in the first embodiment.

In Step S82, ejection data d3 for an image viewed from the side opposite to the recording side is generated. This data is mirrored as described in the first embodiment.

In Step S83, the data d3 is converted into data d3' for each scan in the multi-pass recording. That is, data for each band, i.e., a quarter of data for 4 bands, corresponding to the width of a region for one scanning is generated using a mask for 4-pass recording. Data for first to fourth scanning is thus obtained. As will be described below, the data for each band is stored in a predetermined memory, and is supplied to the driver for the recording head according to each run of scanning.

In Step S84, data for 4 bands (each band being recorded by a different run of scanning) consisting of data d3' corresponding to the ejection ports of the recording heads 10C1, 10M1, 10Y1, 10Y2, 10M2, and 10C2 is supplied to the driver 10A for the individual recording heads for each run of scanning. The dye inks of the individual colors are ejected to the region corresponding to one band. Thereby, a ¼ image of an image Img 1 of the dye inks passed through the porous layer and held by the non-porous layer, corresponding to one band, is formed. At this stage, with respect to the regions corresponding to the other three bands, ⅔, ¾, and ⁴⁄₄ (completion of recording) images are formed.

Similarly, in Step S85, by repeating the transport of the sheet P and scanning (second to fourth scanning) for each band, recording is completed in the region in which the ¼ image has been formed.

By the time in which recording for 4 bands is completed by such multi-pass recording, in Step S86, ejection data d4 corresponding to the 4 bands for a Bk image is generated. When recording for the 4 bands described above is completed, followed by transporting of the sheet P by one band, and when the recorded region corresponds to the array of ejection ports of the recording head 10Bk corresponding to the four bands used for double-side recording, ejection is also performed from the recording head 10Bk during next scanning. An image Img2 is formed by one scanning in the region in which recording has been completed for 4 bands (Step S87). In this image, Bk pigment particles fix on the upper surface of the porous layer, i.e., the recording side, and the image is viewed from the recording side as in the conventional recording.

In Step S88, the sheet is transported by one band as described above, and also it is determined whether recording for the page is completed or not. If not completed, the process described above is repeated back from Step S82.

By the recording process described above, the image Img 1, such as a photo image, is viewed from the back side (transparent base side), and the image Img 2, such as characters, is viewed from the front side.

In this embodiment, when double-side recording is performed using the recording heads, the color image can be formed by multi-pass recording, and thus image quality can be improved. When ordinary single-side recording is performed, characters, etc., can be recorded by the ejection ports of the recording head 10Bk arrayed in a relatively large range, in one pass, and bidirectionally. Thereby, high-speed recording is enabled.

Additionally, in the process shown in FIG. 8, data may be generated by a host computer as in the first embodiment.

Third Embodiment

Figure 9:
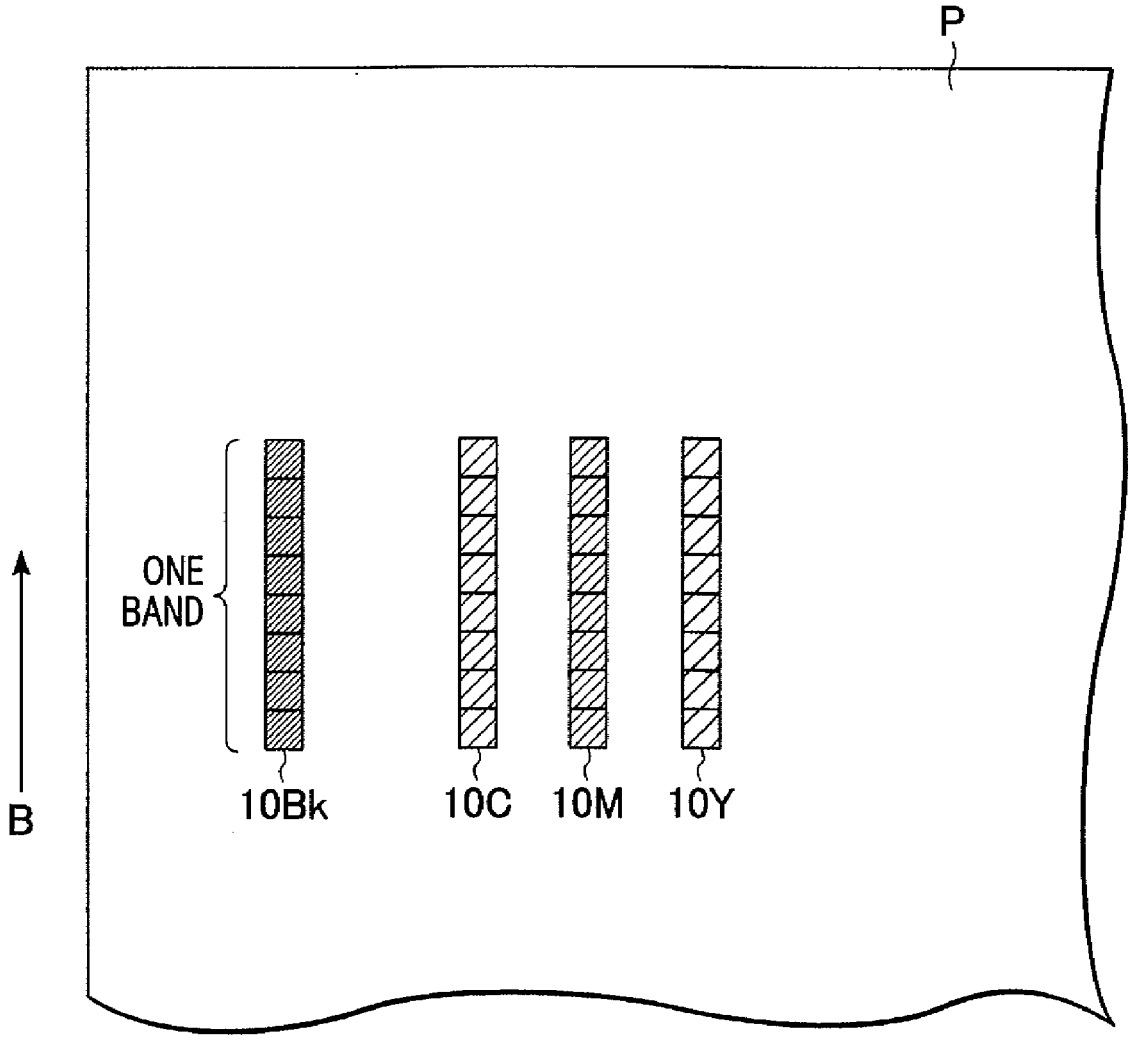
FIG. 9 is a schematic diagram which shows the recording heads for the individual inks and their positional relationship in a third embodiment of the present invention.

In a third embodiment of the present invention, as shown in FIG. 9, a recording head 10Bk for ejecting a pigment ink and color recording heads 10C, 10M, and 10Y for ejecting dye inks are arranged so as to scan the same region in one scanning, unlike the structures described in the previous two embodiments.

In this case, after the dye inks are ejected by forward scanning and permeate through a sheet P, the pigment ink is ejected by backward scanning. In particular, the dye inks and the sheet are adjusted so that the dye inks rapidly permeate through the sheet P. Specifically, the porous layer of the sheet P used in this embodiment has a gap size $\phi h$ of about 20 nm. On the other hand, the dye inks have a dye particle size $\phi d$ of about 2 nm. The relationship $\phi d<\phi h<\phi p$ (pigment particle size) is of course satisfied.

Each of the color dye inks ejected by the recording heads 10C, 10M, and 10Y readily permeates through the recording medium with a surface tension of 30 dyn and a viscosity of 2.0 cp. Each of the recording heads 10C, 10M, and 10Y includes 128 ejection ports arrayed at a density of 600 dpi. Each ejection port ejects 15 pl of ink. On the other hand, the recording head 10Bk includes 128 ejection ports arrayed at a density of 600 dpi, and each ejection port ejects 30 pl of ink. The pigment ink does not readily permeate through the recording medium with a surface tension of 40 dyn and a viscosity of 2.4 cp. The pigment particle size $\phi p$ is about 60 nm.

In this embodiment, even in the structure in which the recording heads having the same width are placed parallel to each other, the color dye inks are ejected in forward scanning and the black pigment ink is ejected in backward scanning so that a time difference occurs. Thereby, it is possible to record an image Img 1 viewed from the back side and an image Img 2 viewed from the recoding side by forward and backward scanning. Although the example described above is a simple bidirectional recording method, a waiting time may be provided between forward scanning and backward scanning in view of the time required for ink permeation (more particularly, the period in which the dye inks pass through the porous layer P1 to reach the non-porous layer P2).

Figure 10:
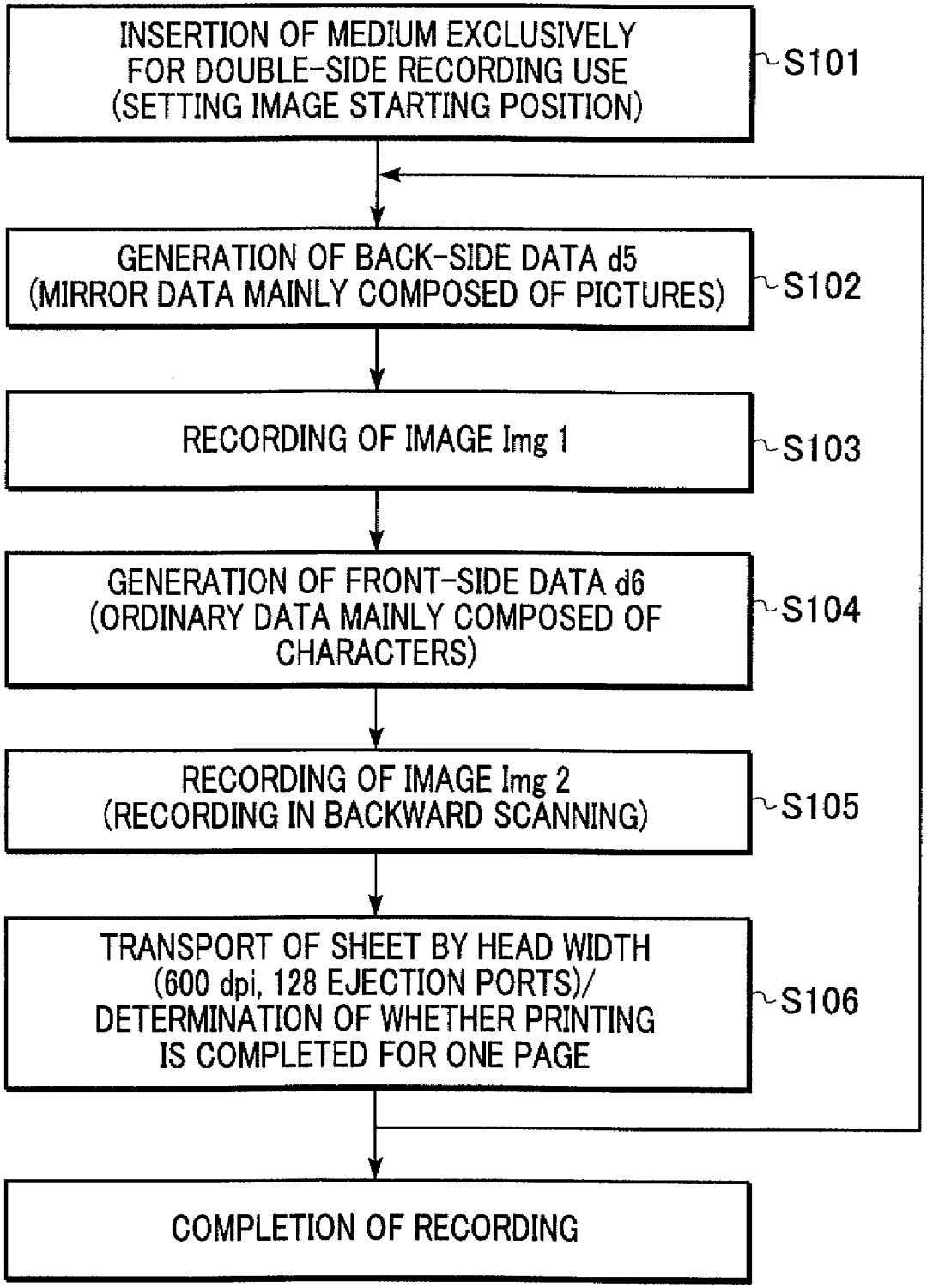
FIG. 10 is a flowchart which shows the recording process in the third embodiment of the present invention.

FIG. 10 is a flowchart which shows the recording process in this embodiment. As in the previous embodiments, a recording sheet is inserted into the feed slot of the recording apparatus and ejection data d5 which is mirror data for the back-side image is generated (S101, S102).

An image Img 1 viewed from the back side is recorded based on the ejection data d5 by forward scanning (S103), and also ejection data d6 for the front-side image is generated (S104). An image Img 2 viewed from the recording side is recorded based on the ejection data d6 by backward scanning (S105). In Step S106, as in the first embodiment, the sheet P is transported by the entire array width of the ejection ports of the recording heads, and also it is determined whether recording is completed. If not completed, the process is repeated back from Step S102.

According to this embodiment, even in the structure in which the recording heads having the same width are placed parallel to each other, by alternately repeating forward scanning and backward scanning, it is possible to simultaneously form images viewable from both sides (front-side image and back-side image). It is possible to reduce the time required for double-side recording by half compared with the conventional double-side recording method in which inks are ejected to the front side and back side alternately.

Fourth Embodiment

In each of the first to third embodiments, the structure in which a head for ejecting a black pigment ink and heads for ejecting color dye inks are used has been described. However, the present invention is not limited thereto. Another head for ejecting a black dye ink may also be added to the structure. In this embodiment, a head for ejecting a black pigment ink, heads for ejecting color dye inks, and a head for ejecting a black dye ink are used. In other words, for the pigment ink, a black pigment is used, and for the dye ink, in addition to the color dyes, a black dye is also used.

For example, with reference to the first embodiment, in the structure of the heads shown in FIG. 4, a head for ejecting a black dye ink is added. Specifically, preferably, the black dye ink head is placed at a position which allows scanning the same region as that scanned by the color dye ink heads 10C, 1M, and 10Y (i.e., just beside the heads 10C, 10M, and 10Y) in a given scan. With reference to the second or third embodiment, based on the same idea, a head for a black dye ink may be added to the structure shown in FIG. 7 or 9.

In this embodiment, in order to perform double-side recording, the black ink and the color dye inks are ejected in substantially the same manner as in the first to third embodiments. That is, prior to the ejection of the black pigment ink, the color dye inks and the black dye ink are ejected based on the mirror data to form the back-side image. Subsequently, the pigment ink is ejected to form the front-side image.

In accordance with the fourth embodiment, since the black ink is also used in addition to the C, M, and Y color inks as the dye inks to form the back-side image, black areas in the back-side image is formed with the black ink. The quality in the black areas is improved compared with the first to third embodiments in which black areas are formed only by the process black produced from a mixture of C, M, and Y.

Fifth Embodiment

The single-side recording mode is not mentioned in the first, third, and fourth embodiments. However, in any one of these embodiments, the structure may be designed so that the double-side recording mode or the single-side recording mode can be selected as in the second embodiment. Additionally, in any one of the embodiments, as the single-side recording mode, either (1) a mode in which only pigment inks are used to form only a front-side image or (2) a mode in which only dye inks are used to form only a back-side image is used.

As described above, in any one of the first to fourth embodiments, the structure may be designed so that either a double-side recording mode or a single-side recording mode can be selected. In such a case, the double-side recording mode or the single-side recording mode may be selected in the liquid crystal display section of an operational panel provided on the recording apparatus or in the display screen of the host computer (PC) connected to the recording apparatus. For example, in the case in which the mode is selected in the liquid crystal display section of the operational panel, an item for mode selection may be displayed in the liquid crystal display section so that the selection can be performed by this item. In the case in which the mode is selected in the display screen of the host computer (PC), a check box for the mode selection may be displayed in the user-interface screen of the printer driver so that selection can be performed by the check box.

Sixth Embodiment

In each of the first to fifth embodiments, a specific recording medium, such as a back print film, only is mentioned, and other recording media are not particularly mentioned. However, in the recording apparatus using the double-side recording mode described in any one of the first to fifth embodiments, recording media other than the specific recording medium (e.g., BPF) can also be recorded. For example, plain paper, glossy paper, and OHP sheets can also be recorded.

Consequently, only when a specific recording medium, such as a back print film, is selected as the recording medium used in the recording apparatus, the double-side recording mode described in any one of the first to fifth embodiments are executed. When a recording medium other than the specific recording medium is selected, the double-side recording mode is not executed.

Additionally, the type of the recording medium used in the recording apparatus may be selected in the liquid crystal display section of an operational panel provided on the recording apparatus or in the display screen of the host computer (PC) connected to the recording apparatus. In any case, only when the recording apparatus recognizes information showing that the recording medium used is the specific recording medium, the double-side recording mode according to any one of the first to fifth embodiments is executed.

Seventh Embodiment

In the first to sixth embodiments, a black pigment (K) ink only is used as the second ink having the coloring material with the particle size $\phi p$. However, the present invention is not limited thereto. In the first to sixth embodiments, as the second ink, color pigment inks, such as C, M, and Y, may be used.

For example, in the first to third embodiments, heads for ejecting color pigment inks may also be used in addition to the head for ejecting the black pigment ink and the heads for ejecting color dye inks. In the fourth embodiment, heads for ejecting color pigment inks may also be used in addition to the head for ejecting the black pigment ink, the heads for ejecting the black dye ink, and the heads for ejecting color dye inks.

In such structures, it is possible to eject not only the black pigment ink but also color pigment inks on the recording side. Therefore, in addition to the black image, a color image can also be formed as the front-side image viewed from the recording side. Of course, as the back-side images viewed from the side opposite to the recording side, a black image and a color image can be formed as described above. Consequently, in accordance with this embodiment, in addition to the black image, a color image can also be produced as both the back-side image and the front-side image.

Other Embodiments

In the embodiments described above, double-side recording methods using one-pass recording, multi-pass recording, and bidirectional recording processes have been described. It is possible to combine these processes. For example, in the structure of the recording heads used in the first embodiment, multi-pass recording may be performed. In the structure of the recording heads used in the second embodiment, one-pass recording may be performed. In the structure of the recording heads used in the first or second embodiment, bidirectional recording may be performed.

In the embodiments described above, the individual inks are ejected by the respective recording heads. However, the individual recording heads may be integrated.

In the embodiments described above, the first ink (dye ink) is ejected based on mirror data. However, when an image to be formed with the first ink is a vertically and horizontally symmetrical image, mirroring is not required.

The structures of the present invention will be related in detail below.

(Structure 1) A An ink jet recording method using a recording head capable of ejecting a first ink containing a coloring material with a relatively small particle size $\phi d$ and a second ink containing a coloring material with a relatively large particle size $\phi p$, the first ink and the second ink being ejected to the same side of a recording medium, the method including the steps of:

selecting a specific recording medium including a porous layer and a base or a recording medium other than the specific recording medium as the recording medium used for recording; and when the specific recording medium is selected, ejecting the first ink from the recording head to the porous layer and then ejecting the second ink from the recording head to a region including the region in which the first ink has been ejected, while relatively moving the recording medium and the recording head, wherein the porous layer has a gap size $\phi h$ that is larger than the particle size $\phi d$ and smaller than the particle size $\phi p$.

(Structure 2) An ink jet recording method using a recording head capable of ejecting a first ink containing a coloring material with a relatively small particle size and a second ink containing a coloring material with a relatively large particle size, the first ink and the second ink being ejected to the same side of a recording medium, the method including the step of:

ejecting the first ink from the recording head to a first side of the recording medium and then ejecting the second ink from the recording head to a region of the first side including the region in which the first ink has been ejected, while relatively moving the recording medium and the recording head, wherein an image recorded with the first ink is viewed from a second side of the recording medium opposite to the first side, and an image recorded with the second ink is viewed from the first side.

(Structure 3) An ink jet recording method using a recording head capable of ejecting a first ink containing a coloring material with a relatively small particle size and a second ink containing a coloring material with a relatively large particle size, the first ink and the second ink being ejected to the same side of a recording medium, the method including the step of:

ejecting the first ink from the recording head to the recording medium and then ejecting the second ink from the recording head to a region including the region in which the first ink has been ejected, while relatively moving the recording medium and the recording head, wherein the first ink is ejected based on mirror data corresponding to a mirror image of the image to be recorded, and the second ink is ejected based on data corresponding to the image to be recorded.

(Structure 4) An ink jet recording method according to either Structure 2 or 3, wherein the relationship $\phi d<\phi h<\phi p$ is satisfied, wherein $\phi d$ is the particle size of the coloring material of the first ink, $\phi p$ is the particle size of the coloring material of the second ink, and $\phi h$ is the gap size of the recording medium.

(Structure 5) An ink jet recording method according to any one of Structures 1 to 3, wherein the first ink more readily permeates through the recording medium than the second ink.

(Structure 6) An ink jet recording method according to any one of Structures 1 to 3, wherein the coloring material of the first ink is a dye, and the coloring material of the second ink is a pigment.

(Structure 7) An ink jet recording method according to either Structure 1 or 2, wherein the first ink is ejected based on mirror data corresponding to a mirror image of the image to be recorded.

(Structure 8) An ink jet recording method according to any one of Structures 1 to 7, wherein the first ink is ejected from a plurality of ink ejection ports to form each dot line in the moving direction during a plurality of relative movements to record an image, and the second ink is ejected from one ink ejection port to form each dot line in the moving direction during one relative movement to record an image.

(Structure 9) An ink jet recording method according to any one of Structures 1 to 7, wherein an image is recorded with the first ink while the recording head is moved in the forward and backward directions, and an image is recorded with the second ink while the recording head is moved either in the forward direction or in the backward direction.

(Structure 10) An ink jet recording method according to any one of Structures 1 to 7, wherein an image is recorded with the first ink while the recording head is moved in the forward direction, and an image is formed with the second ink while the recording head is moved in the backward direction.

(Structure 11) An ink jet recording apparatus capable of performing an ink jet recording method according to any one of Structures 1 to 10.

As described above, in accordance with the present invention, it is possible to record images viewed from the front and back sides of a recording medium only by ejecting a first ink having a relatively small particle size and a second ink having a relatively large particle size to the same side of the recording medium. Consequently, in an ink jet recording apparatus, it is possible to perform double-side recording with a simple structure and it is also possible to perform high-speed double-side recording.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording method using a recording head configured to eject a first ink comprising a coloring material with a relatively small particle size and a second ink comprising a coloring material with a relatively large particle size, the first ink and the second ink being ejected to the same side of a recording medium, the method comprising the step of:

ejecting the first ink from the recording head to the recording medium and then ejecting the second ink from the recording head to the recording medium, while relatively moving the recording medium and the recording head, wherein the first ink is ejected based on mirror data corresponding to a mirror image of an image to be recorded, and the second ink is ejected based on data corresponding to an image to be recorded.

2. The ink jet recording method according to claim 1, wherein the relationship $\phi d<\phi h<\phi p$ is satisfied, wherein $\phi d$ is the particle size of the coloring material of the first ink, $\phi p$ is the particle size of the coloring material of the second ink, and $\phi h$ is the gap size of the recording medium.

3. The ink jet recording method according to claim 1, wherein the coloring material of the first ink is a dye, and the coloring material of the second ink is a pigment.

4. An ink jet recording apparatus, including a recording head configured to eject a first ink comprising a coloring material with a relatively small particle size and a second ink comprising a coloring material with a relatively large particle size, wherein the ink jet recording apparatus performs the ink jet recording method according to claim 1.

* * * * *